US011331177B2

(12) United States Patent
Leguillette

(10) Patent No.: US 11,331,177 B2
(45) Date of Patent: May 17, 2022

(54) EQUINE RESPIRATORY PROSTHETIC DEVICE AND METHODS OF USE

(71) Applicant: Vet Tech Innovations Ltd, Calgary (CA)

(72) Inventor: Renaud Leguillette, Calgary (CA)

(73) Assignee: Vet Tech Innovations Ltd, Calgary (CA)

( * ) Notice: Subject to any disclaimer, the term of this patent is extended or adjusted under 35 U.S.C. 154(b) by 488 days.

(21) Appl. No.: 16/480,565

(22) PCT Filed: Jan. 25, 2018

(86) PCT No.: PCT/CA2018/050087

§ 371 (c)(1),
(2) Date: Jul. 24, 2019

(87) PCT Pub. No.: WO2018/137032

PCT Pub. Date: Aug. 2, 2018

(65) Prior Publication Data

US 2019/0380818 A1 Dec. 19, 2019

Related U.S. Application Data

(60) Provisional application No. 62/451,104, filed on Jan. 27, 2017.

(51) Int. Cl.
*A61D 7/04* (2006.01)
*A61D 99/00* (2006.01)

(52) U.S. Cl.
CPC ..... *A61D 7/04* (2013.01); *A61D 99/00* (2013.01)

(58) Field of Classification Search
None
See application file for complete search history.

(56) References Cited

U.S. PATENT DOCUMENTS 2,672,138 A * 3/1954 Carlock ..... A61F 5/56 128/207.18
5,666,948 A * 9/1997 Matson ..... A61M 15/08 128/200.23
6,561,188 B1 * 5/2003 Ellis ..... A61M 3/0262 128/203.22

(Continued)

FOREIGN PATENT DOCUMENTS

FR 2991571 A1 * 12/2013 ..... A61D 7/04
FR 2991571 B1 6/2015

(Continued)

OTHER PUBLICATIONS

International Search Report and Written Opinion dated Apr. 16, 2018 in corresponding International Patent Application No. PCT/CA2018/050087 (7 pages).

(Continued)

*Primary Examiner* — Kendra D Carter
*Assistant Examiner* — Eric Theisen
(74) *Attorney, Agent, or Firm* — Bereskin & Parr LLP/S.E.N.C.R.L., s.r.l.; Tony Orsi

(57) ABSTRACT

An equine respiratory prosthetic device comprising a nostril prosthesis, including a prosthesis body having a passageway therethrough and an adjacent protrusion for engagement with the nostril cavity and extending into the false nostril of an equine to secure the nostril prosthesis to the nostril.

20 Claims, 7 Drawing Sheets

(56) References Cited

U.S. PATENT DOCUMENTS

| | | | | |
|---|---|---|---|---|
| 7,111,589 | B1 * | 9/2006 | Terwilliger | A61D 7/04 119/800 |
| 7,175,645 | B1 * | 2/2007 | Blach | A61D 7/04 128/200.24 |
| 7,260,923 | B2 * | 8/2007 | Moss | A01K 13/006 54/80.3 |
| 2005/0039739 | A1 * | 2/2005 | Penner | A61M 15/08 128/200.23 |
| 2007/0277832 | A1 * | 12/2007 | Doshi | A61M 16/0688 128/207.18 |
| 2016/0235512 | A1 * | 8/2016 | Miller | A61K 9/08 |
| 2020/0297468 | A1 * | 9/2020 | Marr | A61D 7/00 |

FOREIGN PATENT DOCUMENTS

| | | | |
|---|---|---|---|
| WO | 97/032539 | A1 | 9/1997 |
| WO | 03/011344 | A1 | 2/2003 |

OTHER PUBLICATIONS

Wasko et al., "Evaluation of a risk-screening questionnaire to detect equine lung inflammation: results of a large field study", Equine Veterinary Journal, 2011, 43(2): 145-152.

Winder et al., "Chronic small airway disease in horses slaughtered in Switzerland", Schweiz. Arch. Tierheilk., 1987, 129: 585-593.

International Preliminary Report on Patentability dated Aug. 8, 2019 in corresponding International Patent Application No. PCT/CA2018/050087 (5 pages).

* cited by examiner

EQUINE RESPIRATORY PROSTHETIC DEVICE AND METHODS OF USE

CROSS-REFERENCE

This application is a 35 USC 371 national stage entry of International Patent Application No. PCT/CA2018/050087, filed Jan. 25, 2018, which claims the benefit of U.S. Provisional Patent Application No. 62/451,104, filed Jan. 27, 2017, entitled "EQUINE RESPIRATORY PROSTHETIC DEVICE AND METHODS OF USE"; the entire contents of each of which are hereby incorporated by reference.

FIELD

Various embodiments are described herein for devices and methods to improve the health and well-being of equine animals and, in particular, respiratory prosthetic devices capable of insertion in the nostril of equine animals.

BACKGROUND

Asthma is a chronic, non-infectious airway condition of equine animals that includes heaves, Recurrent Airway Obstruction (RAO), formerly known as Chronic Obstructive Pulmonary Disease (COPD) as well as Inflammatory Airway Disease (IAD). The disease occurs in equines of all ages and is the result of an inflammatory or allergic reaction to inhaled particles. The allergens, such as molds, that cause asthma are primarily environmental airborne particulates found in hay and straw. Other airborne organic particulates such as endotoxins, can also induce an inflammatory reaction that is not specifically targeted to an allergen. Once the particulates are inhaled by an equine, an inflammatory or an allergic reaction is triggered. Inflammation causes the small airways in the equine's lung tissue to narrow, produce mucus, and become obstructed resulting in an occasional cough, exercise intolerance, and nasal discharge.

In Canada, Dr. Leguillette has shown that 66% of horses tested (including horses in an outdoor environment) had moderate asthma, and 17% had severe asthma (A. J. Wasko, H. W. Barkema, J. Nicol, N. Fernandez, N. Logie, R. Léguillette. "Evaluation of a risk-screening questionnaire to detect equine lung inflammation: results of a large field study", Equine Veterinary Journal 2011, 43(2), p. 145-152). A less recent study, performed in Switzerland, showed an asthma prevalence of up to 73% in equine animals (mostly housed indoors). N. C. Winder, R. von Fellenberg, "Chronic small airway disease in horses slaughtered in Switzerland", Schweiz Arch Tierheilkd 1987; 129, p. 585-93).

While there is no cure for asthma, elimination of the allergens from the affected equine's environment often reduces or even resolves the clinical signs. However, preventing exposure to environment dust and allergens is extremely challenging for horse owners. The most important source for these inciting agents are hay, particularly round bale hay, as well as bedding, such as straw.

Equines with asthma ideally should be at pasture with fresh grass as the source of roughage, supplemented with pelleted feed. If equines must be stalled they should be maintained in a clean, controlled environment and fed a dust free diet such as a complete pelleted feed, for example, to minimize dust exposure. Although a common practice, soaking the hay in water prior to feeding is often not practical and not sufficient to control clinical signs in highly sensitive equines.

Decreasing dust exposure does not only encompass eliminating hay and straw from the equine's stall, but also requires the careful evaluation of the animal's environment, stable management practices, and stable design as well as ventilation. While equine animals with asthma are not allergic to outdoor dust such as road dust, for example, their airways are hyper-reactive to nonspecific stimuli. Therefore, equines with airway inflammation should not be kept near a dry, dusty road or paddock. Even so, some parameters such as pollen in air cannot be controlled.

When equines suffering from asthma have respiratory difficulties, medical treatment is required. However, drug administration without minimizing environmental allergen exposure will not provide prolonged benefits. Indeed, medical treatment is not a cure, but a temporary fix with high chances of asthma recurrence (hence the name RAO: Recurrent Airway Obstruction). Asthma is considered as a career limiting disease.

The diagnosis of equine asthma involves interpretation of clinical signs and the results of ancillary diagnostic tests. Horses with severe asthma (RAO) have labored breathing at rest when exposed to dust. Horses with mild asthma (IAD) show exercise intolerance and/or coughing and/or mucoid nasal discharge. The diagnosis is confirmed by the presence of lung inflammation, assessed by cytological analysis of a bronchoalveolar lavage in general. The presence of increased number of inflammatory cells recovered from the bronchoalveolar lavage, combined with the presence of clinical signs as mentioned above, are diagnostic of equine asthma.

Although prevention of exposure to dust and allergens is the cornerstone of a therapeutic plan, medical treatments are often necessary to control the lung inflammation. Medical treatments are usually primarily focusing on the use of anti-inflammatory corticosteroids and eventually bronchodilators. Corticosteroids and bronchodilators can be administered systematically (intravenous, orally, intramuscularly), or by inhalation. Unfortunately, the use of corticosteroids is associated with side effects in horses, warranting a careful dosage and monitoring. Bronchodilators have usually a short duration effect when administered by inhalation and can increase the exposure of lower airways to allergens if the animals are kept in an environment with poor air quality. In addition, the use of medical treatments like cortiscosteroids and bronchodilators is forbidden for most competition usage.

SUMMARY OF VARIOUS EMBODIMENTS

Various embodiments of devices and methods for improving the health and well-being of equines are provided according to the teachings herein. The embodiments described herein generally employ respiratory prosthetic devices.

In a broad aspect, at least one embodiment described herein provides an equine respiratory prosthetic device comprising a nostril prosthesis comprising:

- a prosthesis body being sized and shaped to fit the contours of the nostril of an equine, the prosthesis body having a passageway therethrough; and
- a protruding portion adjacent to the prosthesis body for insertion into the nostril cavity and being sized and shaped to extend into a false nostril of the equine to thereby secure the nostril prosthesis to the nostril of the equine.

In at least some embodiments, the prosthesis body has a coupling portion allowing coupling of a supplemental respiratory device to the prosthesis body.

In at least some embodiments, the prosthesis body has linkage portions to receive a harness arrangement to allow the nostril prosthesis to be held in place to the head of the equine.

In a further broad aspect, at least one embodiment described herein provides an equine respiratory prosthetic device comprising:

a pair of interlinked nostril prostheses each nostril prosthesis comprising:

a prosthesis body being sized and shaped to fit the contours of a nostril of an equine, the prosthesis body having a first passageway therethrough and having a coupling portion allowing for coupling of a supplemental respiratory device to the prosthesis body;

a protruding portion adjacent to the prosthesis body for insertion into the nostril cavity and being sized and shaped to extend into a false nostril of the equine to thereby secure the nostril prosthesis to the nostril; and linking portions to allow the nostril prosthesis to be held in place; and a harness arrangement for interlinking the nostril prostheses to each other and for securing the nostril prosthesis to the head of the equine.

In at least some embodiments, the prosthesis body has an approximate frusto-conical shape.

In at least some embodiments, the prosthesis body and the protruding portion are integrally formed.

In at least some embodiments, the equine respiratory prosthetic device comprises a supplemental respiratory device.

In at least some embodiments, the supplemental respiratory device is removably attachable to the prosthesis body via the coupling portion.

In at least some embodiments, the supplemental respiratory device is a filtering device in gaseous communication with the prosthesis body, the filtering device being coupled to the prosthesis body via the coupling portion, and the filtering device being capable of preventing airborne agents from entering the respiratory system of the equine during use.

In at least some embodiments, the filtering device is removably attachable to the prosthesis body via the coupling portion.

In at least some embodiments, the filtering device comprises a filter, a filter housing and a securing attachment disposed on an exterior surface of a filter housing, and the coupling portion of the prosthesis body comprises a corresponding securing attachment on an interior surface thereof allowing the filtering device to be attached and removed from the nostril prosthesis. In at least some embodiments, the securing attachment disposed at the filter housing comprises threads or a clip.

In at least some embodiments, the supplemental respiratory device comprises a device capable of assessing the respiratory performance of the equine.

In at least some embodiments, the supplemental respiratory device comprises a device capable of measuring airflow and/or oxygen content.

In at least some embodiments, the supplemental respiratory device comprises a flow meter.

In at least some embodiments, the supplemental respiratory device comprises a flow meter, coupled to other respiratory devices capable of assessing lung mechanics and/or function of the equine.

In at least some embodiments, the flow meter comprises a rotatable element disposed within the first passageway and rotatably responsive to airflow therethrough.

In at least some embodiments, the supplemental respiratory device comprises a device for the delivery of a chemical agent to the respiratory system of the equine. In some embodiments, the supplemental respiratory device comprises a nebulizer.

In at least some embodiments, the supplemental respiratory device comprises a cough monitoring device.

In at least some embodiments, the prosthesis comprises at least two supplemental respiratory devices selected from a filtering device, a device capable of measuring airflow and/or oxygen, a device for the delivery of a chemical agent to the respiratory system of the equine, and a cough monitoring device.

In at least some embodiments, at least one of the prostheses comprises a second passageway therethrough linked to a valve, the valve allowing for airflow through the second passageway when the airflow in the first passageway is diminished below a threshold airflow rate level.

In at least some embodiments, the supplementary device comprises a filter having a filtering element with one or more moveable flaps and the valve is formed by the one or more moveable flaps of the filtering element.

In at least some embodiments, the supplementary device is a filter comprising a filtering element and the valve is formed by one or more flaps of a filtering element.

In at least some embodiments, the linking portions comprise loops to receive a first portion of the harness arrangement that is secured to a portion of the equine's head and to receive a second portion of the harness arrangement for coupling with the other nostril prosthesis.

In at least some embodiments, the harness arrangement includes a face cover fabricated of a stretchable material capable of securing the harness arrangement to a portion of the equine's head, and the face cover having the nostril prostheses embedded therein.

In another broad aspect, the present disclosure provides, in at least some embodiments, a method of mounting the respiratory prosthetic device of the disclosure to an equine's head, the method comprising:

attaching nostril prostheses to a harness including interlinking the nostril prostheses to one another;

inserting the first nostril prosthesis into a first nostril of an equine animal;

inserting the second nostril prosthesis into a second nostril of an equine animal; and attaching the harness to the head of the equine animal.

In at least some embodiments, the supplemental respiratory device is coupled to the nostril prostheses prior to attaching the nostril prostheses to the harness.

In at least some embodiments, the supplemental respiratory device is coupled to the nostril prostheses after attaching the nostril prostheses to the harness.

In at least some embodiments, the supplemental respiratory device is coupled to the nostril prostheses prior to attaching the equine respiratory prosthetic device to the equine's head.

In at least some embodiments, the supplemental respiratory device is coupled to the nostril prostheses after attaching the equine respiratory prosthetic device to the equines's head.

In another broad aspect, the present disclosure provides, in at least one embodiment, a use of an equine respiratory prosthetic device to prevent entry of airborne agents into the respiratory system of an equine, the nostril prosthetic device comprising:

a pair of interlinked nostril prostheses each nostril prosthesis comprising:

a prosthesis body being sized and shaped to fit the contours of the nostril of an equine, the prosthesis body having a first passageway therethrough and a coupling portion allowing coupling of a supplemental filtering device to the prosthesis body;

a protruding portion adjacent to the prosthesis body for insertion into a nostril cavity of the equine and being sized and shaped to extend into a false nostril of the equine to thereby secure the nostril prosthesis to the nostril; and linking portions to allow the nostril prosthesis to be held in place;

a supplemental filtering device coupled to the prosthesis body via the coupling portion; and a harness arrangement for interlinking the nostril prostheses to each other and for securing the nostril prosthesis to the head of the equine.

In another broad aspect, the present disclosure provides, in at least one embodiment, a use of an equine respiratory prosthetic device to assess respiratory performance of an equine, the respiratory prosthetic device comprising:

a pair of interlinked nostril prostheses each nostril prosthesis comprising:

a prosthesis body being sized and shaped to fit the contours of a nostril of the equine, the prosthesis body having a first passageway therethrough and a coupling portion allowing coupling of a supplemental respiratory performance device to the prosthesis body;

a protruding portion adjacent to the prosthesis body for insertion into the nostril cavity and being sized and shaped to extend into a false nostril of the equine to thereby secure the nostril prosthesis to the nostril; and linking portions to allow the nostril prosthesis to be held in place;

a supplemental respiratory performance device coupled to the prosthesis body via the coupling portion; and a harness arrangement for interlinking the nostril prostheses to each other and for securing the nostril prosthesis to the head of the equine.

In another broad aspect, the present disclosure provides, in at least one embodiment, a use of an equine respiratory prosthetic device for the delivery of a chemical agent to the respiratory system of an equine, the respiratory prosthetic device comprising:

a pair of interlinked nostril prostheses each nostril prosthesis comprising:

a prosthesis body being sized and shaped to fit the contours of a nostril of the equine, the prosthesis body having a first passageway therethrough and having a coupling portion allowing coupling of a supplemental respiratory delivery device to the prosthesis body;

a protruding portion adjacent to the prosthesis body for insertion into a nostril cavity of the equine and being sized and shaped to extend into a false nostril of the equine to thereby secure the nostril prosthesis; and linking portions to allow the nostril prosthesis to be held in place;

a supplemental respiratory delivery device coupled to the prosthesis body via the coupling portion; and a harness arrangement for interlinking the nostril prostheses to each other and for securing the nostril prosthesis to the head of the equine.

In another broad aspect, the present disclosure provides, in at least one embodiment, a use of a respiratory prosthetic device to increase the airflow through the nostrils of an equine by opening the nostrils of the equine, the respiratory prosthetic device comprising:

a pair of interlinked nostril prostheses each nostril prosthesis comprising:

a prosthesis body being sized and shaped to fit the contours of the nostril of an equine, the prosthesis body having a passageway therethrough;

a protruding portion adjacent to the prosthesis body for insertion into a nostril cavity of the equine and being sized and shaped to extend into a false nostril of the equine to thereby secure the nostril prosthesis to the nostril; and linking portions to allow the nostril prosthesis to be held in place; and a harness arrangement for interlinking the nostril prostheses to each other and for securing the nostril prosthesis to the head of the equine.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

FIG. 5B) and front views (FIG. 5C; FIG. 5D) of an equine's head including a first example embodiment (FIG. 5A; FIG. 5C) and a second example embodiment (FIG. 5B; FIG. 5D) of a harness arrangement in accordance with the teachings herein.

FIG. 7C) and perspective views (FIG. 7B; FIG. 7D) of an example embodiment of a filtering device wherein the filtering device includes flaps capable of forming a passageway with the flaps shown in a closed position (FIG. 7A and FIG. 7B) and an open position (FIG. 7C and FIG. 7D).

Figure 1A:
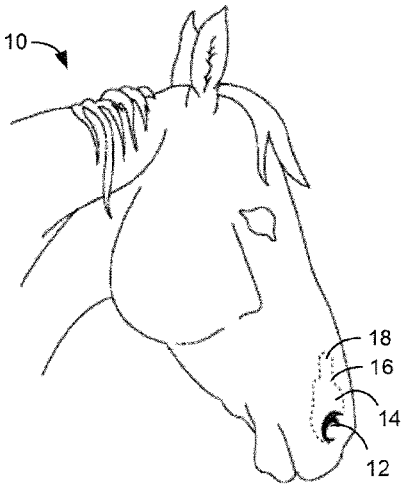
FIG. 1A is a side view of an equine's head without wearing the respiratory prosthetic device.

Further aspects and features of the example embodiments described herein will appear from the following description taken together with the accompanying drawings.

DETAILED DESCRIPTION OF THE EMBODIMENTS

Various embodiments in accordance with the teachings herein will be described below to provide an example of at least one embodiment of the claimed subject matter. No embodiment described herein limits any claimed subject matter. The claimed subject matter is not limited to devices or methods having all of the features of any one of the devices or methods described below or to features common to multiple or all of the devices and or methods described herein. It is possible that there may be a device or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should be noted that the terms "coupled" or "coupling" as used herein can have several different meanings depending in the context in which these terms are used. For example, the terms coupled or coupling can have a mechanical or gaseous connotation. For example, as used herein, the terms coupled or coupling can indicate that two elements or devices can be directly connected to one another or connected to one another through one or more intermediate mechanical elements or by an open passageway, a conduit or channel, or a gas (e.g. air) permeable passageway, depending on the particular context.

It should be noted that the terms "equine" and "equine animals", as used herein refer to all animals belonging to the genus *Equus*, including, without limitation domestic horses, i.e. *Equus ferus caballus*.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as 1%, 2%, 5% or 10%, for example, if this deviation would not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5% or 10%, for example.

According to the teachings herein, various embodiments of devices and methods that aim to help in the management of asthma for equines will now be described. However, it should be noted that such devices may also be used in healthy equines at risk of exposure to airborne agents, such as fungal, bacterial or viral agents, for example.

Referring now to FIG. 1A, shown therein is a side view of the head of an equine 10 which is directly breathing air from its environment. The equine 10 breathes air only through its nostrils 12 and not through its mouth because it has a soft palate that blocks the mouth cavity from the trachia that lead to the lungs of the equine 10. The nostrils 12 provide a large opening for air to enter via the nasal chamber (not shown) into the respiratory system of the equine 10. The nostrils 12 are also flexible so that they can widen or narrow to vary the amount of air that enters the respiratory system of the equine 10 based on the exertion condition that is currently being experienced by the equine 10.

The flexibility of the nostrils 12 is due to alar cartilage that is at the upper and bottom portions of the nostrils 12 such that the lateral walls of the nostrils 12 are unsupported which allows a greater range of movement for the nostrils 12. Each nostril 12 comprises an internal nostril cavity 14 extending up the equine's head to form a false nostril 16 (also known as the nasal diverticulum) and narrowing to a closed point 18. The false nostril can be about 3 or 4 inches in length.

Figure 1B:
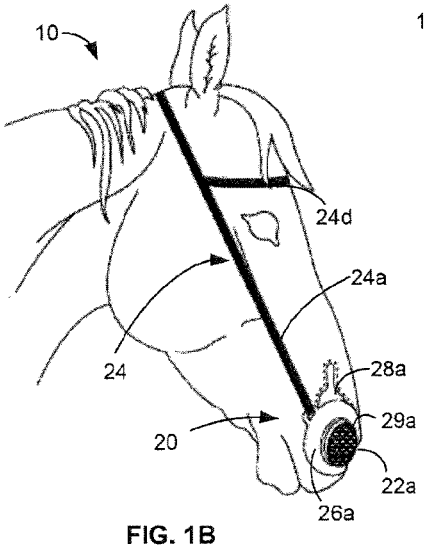
FIGS. 1B-1C are side and front views, respectively, of the equine of FIG. 1 wearing an example embodiment of a respiratory prosthetic device that can be used for various purposes, including air filtering in accordance with the teachings herein.
Figure 1C:
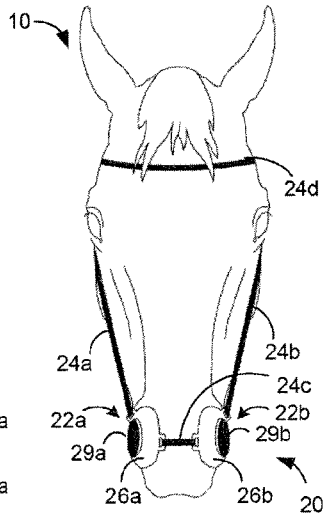

Referring now to FIGS. 1B-1C, shown therein are side and front views, respectively, of the equine 10 of FIG. 1 wearing an example embodiment of a respiratory prosthetic device 20 in accordance with the teachings herein. The respiratory prosthetic device 20 comprises two nostril prostheses 22*a* and 22*b*, a harness arrangement 24 and a supplemental respiratory device comprising, in this embodiment, a filtering device 29*a* and 29*b*. The nostril prostheses 22*a* and 22*b* are made of somewhat flexible material and are coupled to one another such that they can be shaped to correspond to the contours of the equine's nasal region and can be kept in place if the equine's nostrils 12 move. The nostril prostheses

22*a* and 22*b* are mounted to the equine 10 in a form fitting manner to prevent unfiltered air from passing into the nasal passages of the equine 10.

The harness arrangement 24 holds the two nostril prostheses 22*a* and 22*b* in place once they are mounted on the head of the equine 10. The harness arrangement 24 comprises, in some embodiments, several securing members 24*a*, 24*b*, 24*c* and 24*d* that interlink the nostril prostheses 22*a* and 22*b* to each other for securing the nostril prosthesis 22*a* and 22*b* to the head of the equine 10. In other embodiments, the harness arrangement 24 comprises a face cover, for example a neoprene or lycra "sock", to which the nostril prostheses 22*a* and 22*b* are attached, for example by embedding the nostril prostheses therein (the nostril prostheses 22*a* and 22*b* are still mounted to the nostrils of the equine 10 in a similar manner).

The harness arrangement 24 can be made using various materials and structural elements as is known to those skilled in the art. For example, the securing members 24*a*-24*d* can be elastic, or can be implemented as flexible leather straps.

Two example embodiments of a face cover are shown in FIGS. 5A-5D. In a first example embodiment, shown in FIG. 5A (side view) and FIG. 5C (front view), a face cover 52 manufactured from a stretchable material in which the nostril prostheses 22*a* and 22*b* have been embedded is sized to cover the lower portion of the head of the equine 10. The face cover 52 is held in place by virtue of the stretchability of the material forming a snug fit around the face of the equine 10. The face cover 52 can be manufactured so that it comprises a left portion 52*a* and a right portion 52*b* and a fastening member 59, for example zipper, or one or more buttons, which can be fastened to hold the face cover 52 in place over the head of the equine 10, or released to remove the face cover 52 from the head of the equine 10. It is noted that the face cover 52 is manufactured so that the mouth 53 of the equine 10 remains unobstructed. Thus, the equine 10 is free to feed while wearing face cover 52.

Figure 5A:
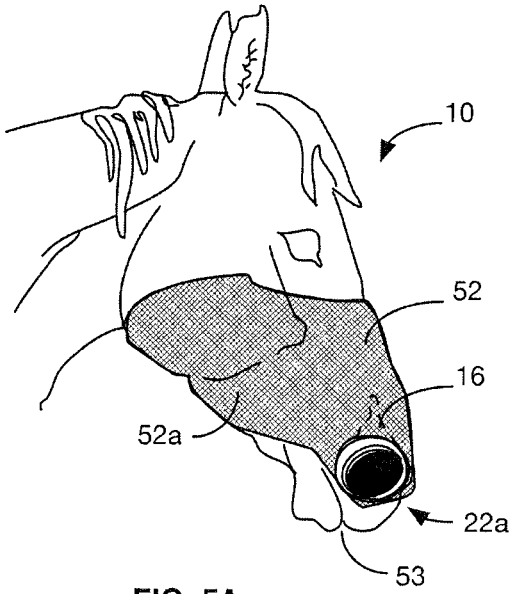
FIGS. 5A-5D are side views (FIG. 5A.
Figure 5B:
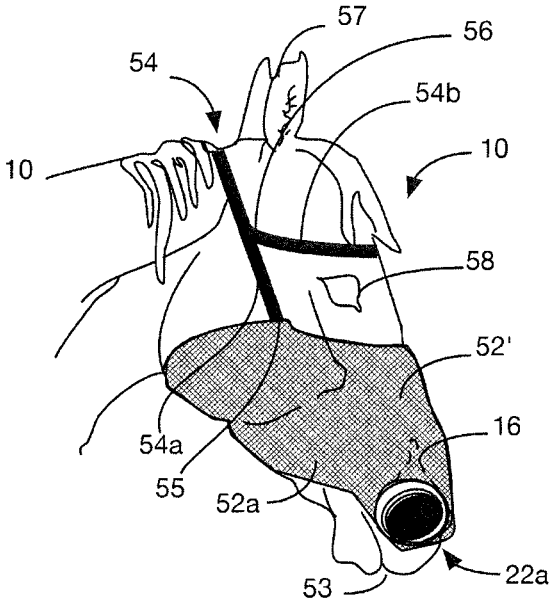
Figure 5C:
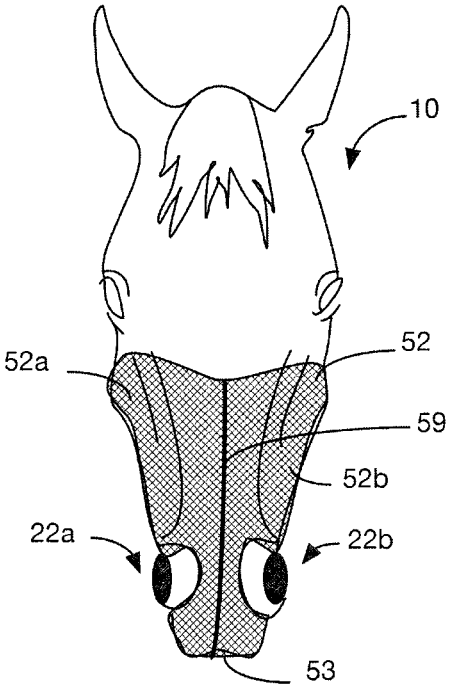
Figure 5D:
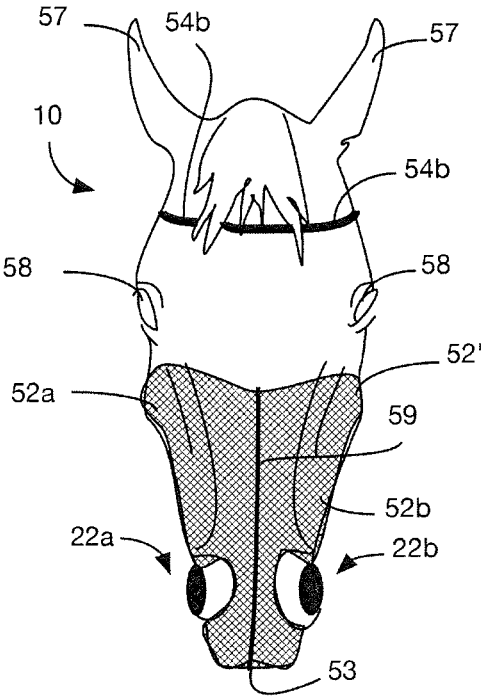

In a second example embodiment, shown in FIG. 5B (side view) and FIG. 5D (front view), similar to the first example embodiment, a face cover 52' manufactured from a stretchable material in which the nostril prostheses 22*a* and 22*b* have been embedded is employed. In the second example embodiment, the face cover 52' is further held in place by a securing member 54. The securing member comprises two approximately U-shaped straps 54*a*, 54*b*. One end of strap 54*a* is attached to the left portion 52*a* of face cover 52' at attachment junction 55, and the other end is attached to right portion 52*b* of face cover 52 at an attachment junction (not visible) and the strap 54*a* runs from one side to the other of the equine animal 10 about the head behind the ears 57. Both ends of U-shaped strap 54*b* are attached to the first strap 54*a* in a manner that allows strap 54*b* to form a connection between two different points on strap 54*a*: a point covering the left side of the face of the equine animal 10, and a point covering the right side of the face of the equine animal 10, for example above the eyes 58. The left attachment junction 56 between straps 54*a* and 54*b* is shown.

The nostril prostheses 22*a* and 22*b* each comprise a prosthesis body 26*a* and 26*b*, respectively, that are sized and shaped to fit the exterior surface contours of the nostrils 12 of the equine 10 and have a passageway to allow air to pass therethrough in both directions. The nostril prostheses 22*a* and 22*b*, respectively, also each comprise nostril inserts 28*a* and 28*b* that are adjacent to the respective prosthesis body 26*a* and 26*b*. The nostril inserts 28*a* and 28*b* are protruding portions that protrude from the prosthesis bodies 26*a* and 26*b*, and are generally shaped and sized to conform (i.e. fit) the corresponding interior nostril cavity 14 and extend into the false nostril 16 (i.e. pouches) of the equine 10 which allows the nostril prostheses 22*a* and 22*b* to be secured at the nostrils 12 of the equine 10.

In at least some embodiments, the prosthesis bodies 26*a* and 26*b* are integrally formed with the nostril inserts 28*a* and 28*b*. For example, based on an MRI, a 3D model of the nostrils of the equine 10 can be created. The 3D model can then be used to create the nostril inserts 28*a* and 28*b* and the prosthesis bodies 26*a* and 26*b* using an appropriate manufacturing technique and materials, such as a low density polyethylene, including, but not limited to, a foodgrade quality polyethylene, a polypropylene, latex, urethane, acrylic materials or flexible resin materials. For example, 3D printing may be used for small and midsize scale production, whereas for large scale production, molds can be created based on the 3D model and the nostril inserts 28*a* and 28*b* and the prosthesis bodies 26*a* and 26*b* can be made from the molds. Alternatively, another approach can be to manufacture 3 or more different sizes of prosthesis bodies 26*a* and 26*b* and nostril inserts 28*a* and 28*b* which can be somewhat flexible to fit various nostril sizes, or sized to fit, for example, ponies, foal equines and adult equines of various sizes and breeds.

Alternatively, in at least some embodiments, the prosthesis bodies 26*a* and 26*b* are formed separately from the corresponding nostril inserts 28*a* and 28*b* and then attached to the corresponding nostril inserts 28*a* and 28*b* by using an attachment device such as glue, a clamp, screws, grooves, screw threads, and a fastener, for example.

The prosthesis bodies 26*a* and 26*b*, as well as the nostril inserts 28*a* and 28*b* can be made of a flexible, non-allergenic, non-irritant material, such as various silicons or soft plastics, a low density polyethylene, including, but not limited to, a foodgrade quality polyethylene, a polypropylene, latex, urethane, acrylic materials or flexible resin materials, that are preferably resistant to deterioration, for example by moisture or mucus. The flexibility of the material used to manufacture the prosthesis bodies 26*a* and 26*b* can be the same or different from the material used to manufacture the nostril inserts 28*a* and 28*b*. Thus, for example, the prosthesis body can be manufactured using a somewhat harder plastic and the nostril insert can be manufactured using a softer plastic or a silicon.

The respiratory prosthetic device 20 further comprise filtering devices 29*a* and 29*b*, that are in gaseous communication with the corresponding prosthesis bodies 26*a* and 26*b*. The filtering devices 29*a* and 29*b* are capable of preventing airborne agents from entering the nostrils of the equine 10 when the respiratory prosthetic device 20 is being worn. In at least one embodiment, the filtering devices 29*a* and 29*b* may be integral with the nostril prostheses 22*a* and 22*b*, respectively. Alternatively, in another embodiment, the filters 29*a* and 29*b* can be removably attachable to the nostril prostheses 22*a* and 22*b*, respectively, using a securing attachment as further described hereinafter with reference to FIG. 3A and FIG. 3B. In both of these types of embodiments, the outer surface of the filtering devices 29*a* and 29*b* can be flush or approximately flush with the surrounding outer surfaces of the prosthesis bodies 26*a* and 26*b*, respectively. Alternatively, in both of these types of embodiments, the outer surface of the filtering devices 29*a* and 29*b* can protrude out from the surrounding outer surfaces of the prosthesis bodies 26*a* and 26*b*, respectively.

Based on the type of filtering devices 29*a* and 29*b* that are used, the respiratory prosthetic device 20 can be used to filter air borne agents, such as particulate matter dust, virus, fungus (e.g. mold) and bacteria from air that is incoming (i.e. incoming air into the equine's nostril) and prevent entry thereof into the respiratory system of the equine 10. Thus, for example, filters having a pore size ranging from about 0.1 μm to about 1,000 μm, for example, such as about 0.1 μm, 0.2 μm, 0.3 μm, 0.4 μm, 0.5 μm, 0.6 μm, 0.7 μm, 0.8 μm 0.9 μm, 1 μm, 5 μm, 10 μm, 100 μm, 250 μm, 500 μm or 1,000 μm may be used. For example, National Institute for Occupational Health and Safety (NIOSH) N95 filters may be used. Such filters can generally prevent entry of 95% of viral agents into the nasal passage of the equine animal. Other filters can be used in other embodiments that are suitable for the particular equine that uses the respiratory prosthetic device 20 or the conditions under which the respiratory prosthetic device 20 is used. In general, the respiratory prosthetic device 20 will not stop the equine 10 from feeding, sleeping, scratching itches, or breathing normally or while at rest, and thus results in minimal interference of ordinary equine behavior and therefore can be worn by equines for extended periods of time. The respiratory prosthetic device 20 can also be used in the management of headshaking, trackway dust, and to increase air temperature when the equine is exposed to below freezing conditions.

Figure 2A:
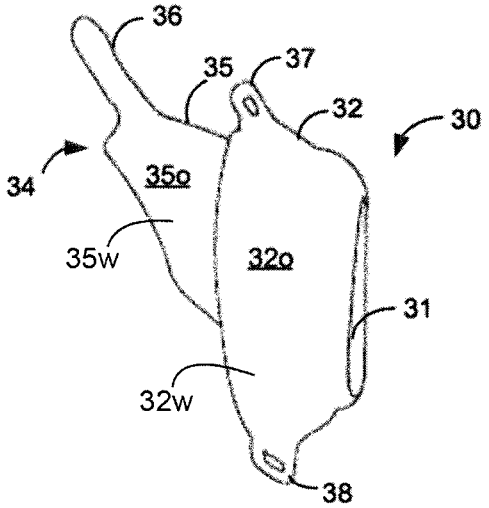
FIGS. 2A-2C are side, front perspective and rear perspective views of an example embodiment of a nostril prosthesis without the supplemental respiratory device that may be used with the respiratory prosthetic device of FIGS. 1B-1C in accordance with the teachings herein.
Figure 2B:
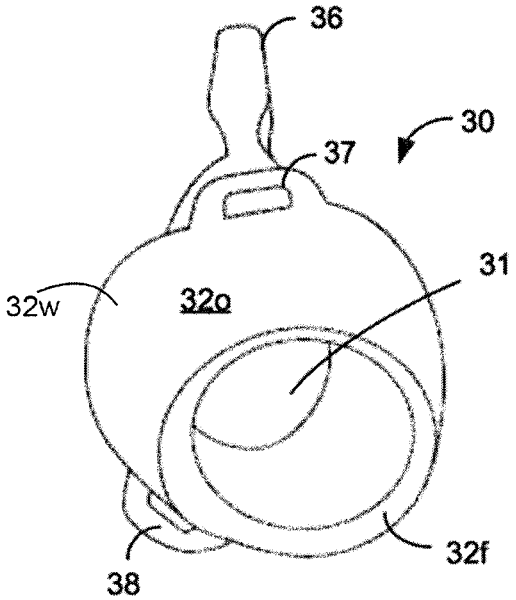
Figure 2C:
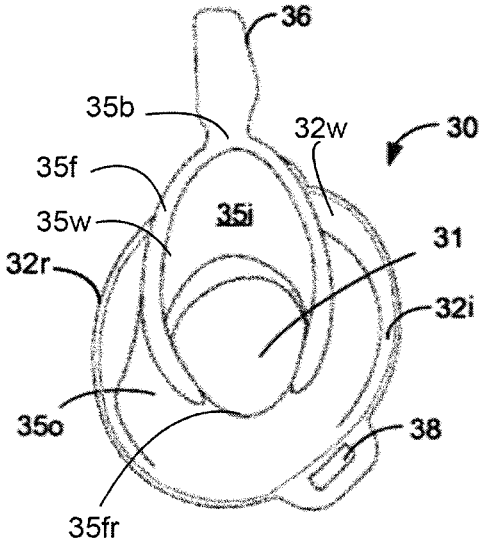

Referring now to FIGS. 2A-2C, shown therein are side, front perspective and rear perspective views of an example embodiment of a nostril prosthesis 30. In some embodiments, the nostril prosthesis 30 can be used with the respiratory prosthetic device 20 of FIGS. 1B-1C in accordance with the teachings herein. The nostril prosthesis 30 comprises a prosthesis body 32, a nostril insert 34 and linking portions 37 and 38 for coupling to the harness arrangement 24. The prosthesis body 32 and the nostril insert 34 can be integrally formed.

The prosthesis body 32 comprises a wall 32*w* that provides a housing for the nostril prosthesis 30. The wall 32*w* has an outer surface 32*o* and an inner surface 32*i*. The wall 32*w* is generally cylindrical in shape but flares out from a front face 32*f* to a rear face 32*r* such that the wall 32*w* is also slightly frusto-conical in shape. A passageway 31 is defined by the front face 32*f* and the wall 32*w* of the prosthesis body 32 and, as it extends rearwardly, further by inner surface portion 35*i* of the nostril insert 34. The rearward facing wall 32*r* is flexible and can be more or less irregularly shaped so that the rearward facing wall surface 32*r* can conform to the outer surface of the corresponding nostril of the equine 10. The passageway 31 permits incoming air to pass through the nostril into the nasal chamber of the equine 10 and outcoming air to pass from the nostril of the equine 10 to the outer environment of the nostril prostheses 30.

The nostril insert 34 is a rearward extending protrusion that is adjacent to the prosthesis body 32 and comprises a medially located nostril body insert 35 and a distally located false nostril insert 36. The nostril body insert 35, which is generally frusto-conically shaped, comprises a rearwardly extending wall 35*w* having an outer surface 35*o* and inner surface 35*i*. The wall 35*w* extends rearwardly in a tapered manner so that the front portion 35*fr* of the wall 35*w* extends rearwardly approximately as far as the rear face 32*r* of the wall 32*w*, and the back portion 35*b* extends rearwardly substantially further than the rear face 32*r* of the wall 32*w*. The rearward face 35*f* of the nostril body insert 35 generally forms an elliptical shape. The nostril body insert 35 of the nostril insert 34 is sized and shaped such that the outer surface 35*o* of the nostril body insert 35 fits within and engages the inner surfaces of the nostril cavity 14 of the equine 10 as shown in FIG. 1B.

The false nostril insert 36 of the nostril insert 34, extends further rearward from the back portion 35*b* of the nostril body insert 35, and has a curved rectilinear shape that is sized to fit within and engage a portion of the inner surface of the false nostril 16 of the equine 10. In some embodiments, the false nostril insert 36 of the nostril insert 34 engages with the closed point 18 of the false nostril 16 of the equine 10. In other embodiments, the false nostril insert 36 is somewhat shorter and engages with a portion of the inner surfaces of the false nostril 16 of the equine but does not extend entirely to the closed point 18. The false nostril insert 36 can be a solid body. The nostril body insert 35 and the false nostril insert 36 together are sized such that the internal nostril cavity 14 of the nostril 12 of the equine 10 has sufficiently clear area to allow a sufficient amount of incoming air to pass therethrough to the air passages that lead to the equine's lungs as well as allow expelled air from the equine's lungs to exit the nostril 12 of the equine 10 to the surrounding environment.

In some embodiments, the nostril body insert 35 can be about 6-7 cm in length measured from its attachment point to the prosthesis body 32 to the attachment point of the false nostril insert 36, and the false nostril insert 36 can be about 3-4 cm in length, measured from its attachment point to the nostril body insert 35 to the distal tip of the false nostril insert 36. Different sizes can be used for equines that are of different size or age.

The linking portions 37 and 38 allow the nostril prosthesis 30 to be attached to different portions of the harness arrangement 24 for holding the nostril prosthesis 30 in place once it has been placed on the nostrils 12 of the equine 10. In this example embodiment, the linking portion 37 comprises a first loop to receive a first portion 24*b* of the harness arrangement 24 that is secured to a portion of the equine's head and the linking portion 38 is a second loop to receive a second portion 24*c* of the harness arrangement 24 for coupling with the other nostril prosthesis. In other embodiments, the linking portions 37 and 38 are composed of 2 loops linked together by a V-shaped portion of the harness arrangement, for example, a V-shaped portion of a leather strap.

It is noted that in this example embodiment, no supplementary respiratory device is shown.

Figure 3A:
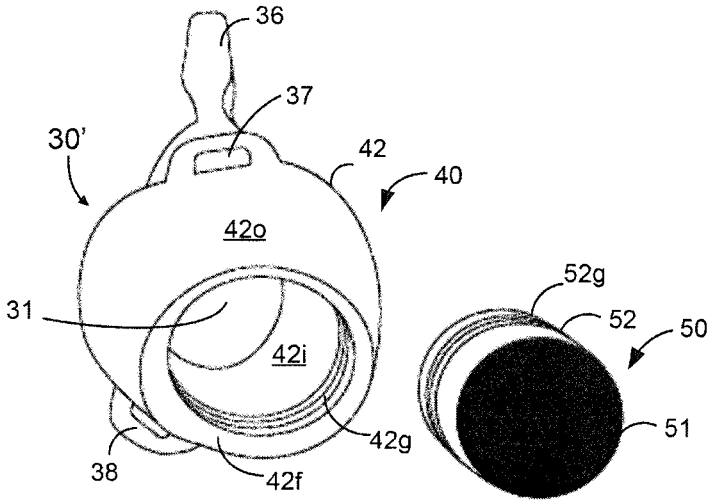
FIG. 3A is a view of another example embodiment of the nostril prosthesis including a supplemental filtering device comprising a filter housing and a filter where the filtering device can be removably attached to the nostril prosthesis.
Figure 3B:
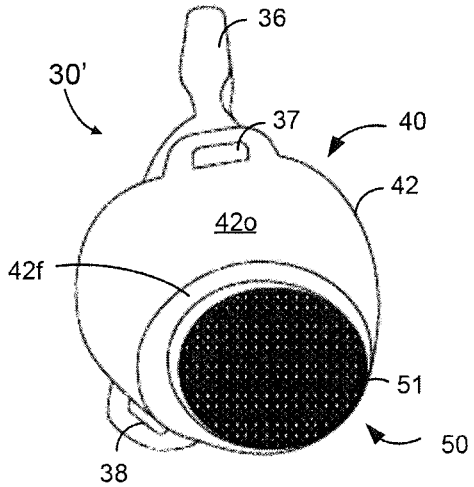
FIG. 3B is a view of the filtering device, filter and filter housing of FIG. 3A where the filter housing is attached to the nostril prosthesis.

Referring now to FIGS. 3A and 3B, FIG. 3A shows a view of another example embodiment of a respiratory prosthetic device 30' including a nostril prosthesis 40 and a supplemental filtering device 50 comprising a filter housing 52 and a filter element 51. The filtering device 50 can be removably attached to the prosthesis 40 using a securing attachment disposed at the filter housing 52 and a corresponding securing attachment on the nostril prosthesis 40. FIG. 3B shows a view of the supplemental filtering device 50 and the nostril prosthesis 40 of FIG. 3A where the supplemental filtering device 50 is attached to the nostril prosthesis 40. The nostril prosthesis 40 comprises a wall 42 that forms a housing and has an outer surface 42*o*, a front surface face portion 42*f* and a coupling portion comprising an inner surface 42*i* with grooves 42*g* thereon. The supplemental filtering device 50 comprises a generally cylindrical filter housing 52 with threads 52*g* on an exterior surface thereof that correspond to the grooves 42*g* on the interior surface 42*i* of the prosthesis 40.

In this example embodiment, the supplemental filtering device 50 is removably attachable to the prosthesis 40 and can be attached by being screwed into the prosthesis 40. The grooves 42*g* on the interior surface 42*i* of the prosthesis 40 receive the threads of the 52*g* of the supplemental filtering device 50 which allows the supplemental filtering device 50 to be attached and removed from the prosthesis 40. In other embodiments, other securing attachments may be used to attach the supplemental filtering device, for example, using clips, snaps, a clamp or a friction fit.

In at least some embodiments, the supplemental respiratory device is a device capable of assessing the respiratory performance of the equine that is wearing the respiratory prosthetic device. In some embodiments, the supplemental respiratory device is capable of measuring airflow and/or oxygen content. In some embodiments, the supplemental respiratory device is a flow meter.

Figure 6:
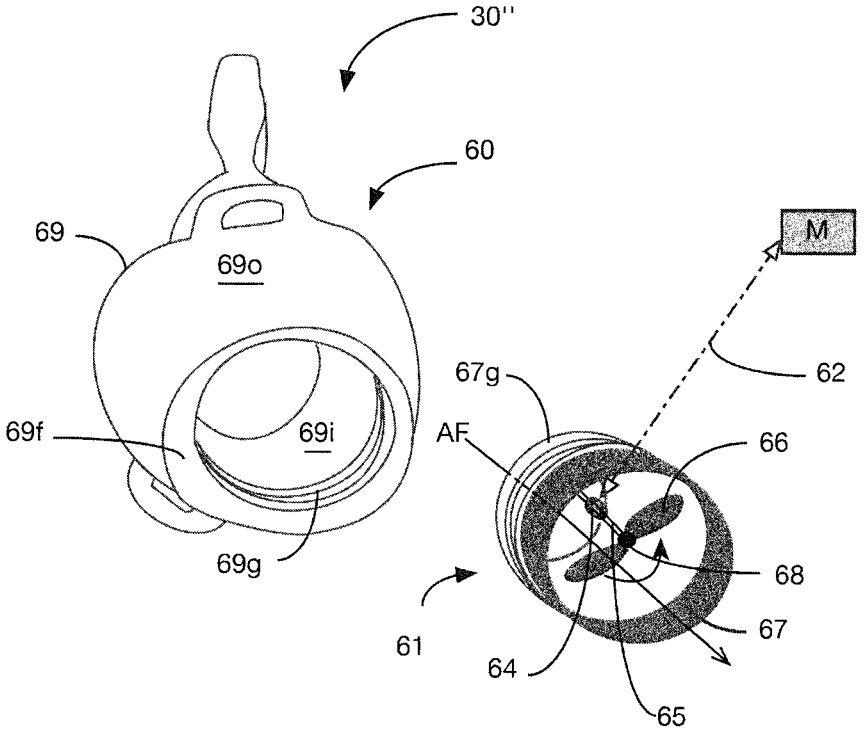
FIG. 6 is a front perspective view of the nostril prosthesis including an example embodiment of a supplemental flow meter device where the supplemental flow meter can be reversibly attached to the nostril prosthesis.

Referring now to FIG. 6, shown therein is a view of another example embodiment of a respiratory prosthetic device 30" including a nostril prosthesis 60 and a supplemental flow meter device 61 comprising a cylindrical housing 67 and a rotatable element 68. The nostril prosthesis 60 comprises a wall 69 that forms a housing and has an outer surface 69*o*, a front surface face portion 69*f* and a coupling portion comprising an inner surface 69*i* with grooves 69*g* thereon. The respiratory prosthetic device 61 comprises threads 67*g* on an exterior surface thereof that correspond to the grooves 69*g* on the interior surface 69*g* of the prosthesis 60, allowing for the removable attachment of the supplemental flow meter device 61 to the nostril prosthesis 60. The rotatable element 66 comprises a propeller 66 with a shaft or post, is disposed in the airflow path, and can rotate about rotatable axis 65 in response to airflow (AF) through the housing of the supplemental flow meter device 61. The airflow can be caused by an equine animal equipped with prosthetic device 30" exhaling or inhaling. The supplemental flow meter 61 comprises a rotational sensor 64 that is coupled to the rotatable element 66 to measure the amount of rotation of the rotatable element 66. A monitoring device (M) is coupled to the rotational sensor 64 via a wireless connection 62, and can be used to collect information regarding the rotation of the rotatable element 68, and determine the amount of airflow and breathing behavior of the equine animal based on the size of the airflow path and the number of rotations of the rotatable element 66 during a certain time frame.

In some embodiments, the supplemental respiratory device is a flow meter, coupled to other respiratory devices capable of assessing lung mechanics and/or function of the equine, for example, computer equipment configured to receive and process the flowrate information from the flow meter, and provide output regarding lung mechanics and/or function of the equine using known quantitative relationships between flowrate and lungs. By assessing respiratory performance certain airway conditions, such as asthma and heaves can be diagnosed, and the level of physical conditioning and training can be assessed.

In at least some embodiments, the supplemental respiratory device is a device for monitoring cough, for example, a cough monitoring device including a microphone capable of monitoring equine coughing sounds. The microphone can be connected to computer equipment configured to receive, record and process sounds from the microphone and provide output regarding the coughing behavior of the equine such as frequency and severity of coughing.

In at least some embodiments, the supplemental respiratory device is a device for the delivery of a chemical agent to the respiratory system of a horse. For example, in some embodiments, the supplemental respiratory device is a nebulizer, including, for example, a jet nebulizer or an ultrasonic nebulizer. In some embodiments, the chemical agents are a veterinary medicinal agent, for example, a veterinary medicinal agent capable of preventing, ameliorating or treating an equine respiratory condition. Veterinary medicinal agents that can be used include, but are not limited to, anti-inflammatory steroids, such as dexamethasone, beclomethasone, fluticasone or isoflupredone; bronchodilators, such as ipratropium, salbutamol, albuterol, or clenbuterol; antibiotics, such as ceftiofur, gentamicin; vaccines, such as vaccines against strangle or influenza; or one or more essential oils.

It is noted that, in at least some embodiments, the supplemental respiratory device comprises at least two of a filtering device, a device capable of measuring airflow and/or oxygen, a device for the delivery of a chemical agent to the respiratory system of the equine, and a cough monitoring device. Thus, for example, the supplemental respiratory device may include a filter and a device capable of measuring airflow and/or oxygen. For example, referring again to FIG. 6, one can place a filtering element within the cylindrical housing 67. In other embodiments, one can combine a filtering device and a cough monitoring device, or a filtering device, a cough monitoring device and a device for the delivery of a chemical agent, etc. In some embodiments one of the prostheses may include a first supplemental respiratory device and another prosthesis may include a second supplemental respiratory device. The first and second supplemental respiratory devices can be the same or different. It will thus be clear that the prosthetic device of the present disclosure in this manner may be used as a "platform" for the attachment of multiple supplemental respiratory devices.

It is noted that in general upon implementing the prosthetic device, according to any of the embodiments described herein, the equine can breathe substantially normally and airflow within the equine airways is minimally impacted, with airflow being diminished by no more than about 5%, 4%, 3%, 2%, or 1%, as can, for example, be determined using a flow meter, relative to when no device is implemented.

In at least some embodiments, at least one of the prostheses comprises a second passageway therethrough linked to a valve. In at least some embodiments, a supplementary respiratory device comprises a second passageway therethrough linked to a valve. The valve, for example a flap, allows for airflow through the second passageway when the airflow in the first passageway is diminished below a threshold airflow rate level. The valve preferably opens when the airflow is insufficient for the equine to breath normally. Thus the second passageway and valve represent a safety feature which can ensure that air can continue to flow even if the first passageway becomes occluded, for example, in an embodiment in which a supplemental filtering device is used, in instances when the filter element is fouled or clogged and airflow is diminished. It is noted that the term "second passageway", as used herein, refers broadly to any passageway which allows for the flow of air through the prosthesis when the equine cannot breathe substantially normally because the airflow through the first passageway is diminished below a certain level. For example, when the airflow through the first passageway is diminished by about 10%, 25% or 50%, and when the equine cannot breathe substantially normally, the second passageway opens. Conversely, when the airflow through the first passageway remains at least at about 90%, at least at about 75%, or at least about 50%, relative to the airflow in the absence of the equine being equipped with a prosthetic device, and the equine animal can breathe substantially normally, the second passageway remains closed.

Figure 7A:
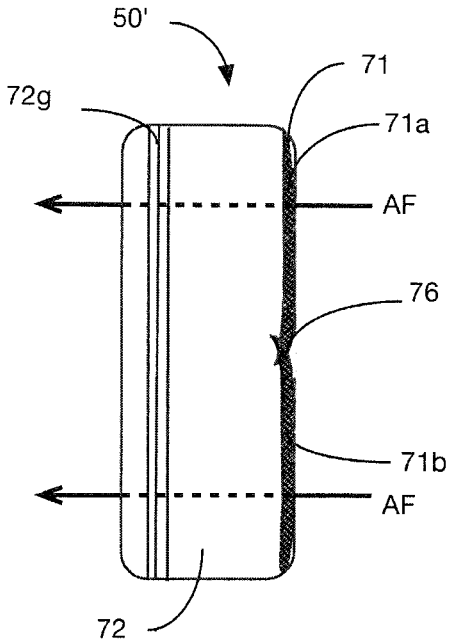
FIGS. 7A-7D are side views (FIG. 7A.
Figure 7C:
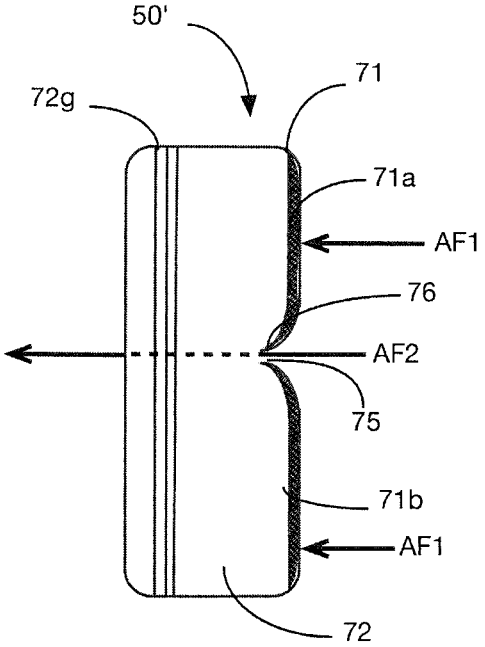
Figure 7B:
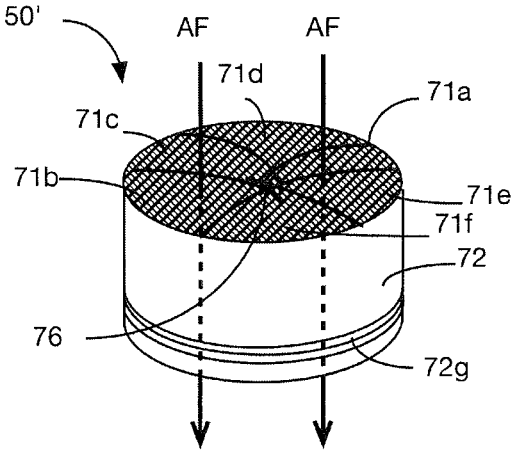
Figure 7D:
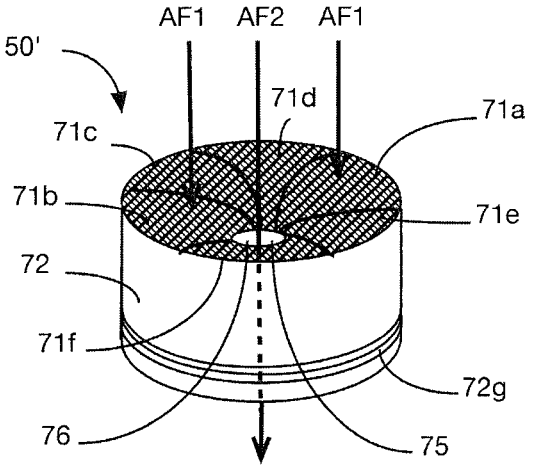

Referring now to FIG. 7A-7D, FIGS. 7A and 7B show side and perspective views, respectively, of a supplemental filtering device 50' comprising a filter housing 72 including threads 72*g* for removable attachment to a prosthesis (not shown). The filtering device 50' further comprises a filter element 71 comprised of six centrally overlapping filter element portions 71*a*, 71*b*, 71*c*, 71*d*, 71*e*, 71*f*, together forming a closed valve. It is noted that in other embodiments more or less overlapping filter element portions can be used, for example 1, 2, 3, 4, 5, 7, 8, 9, 10 or more portions. Airflow (AF) can be achieved through filter element 71. FIGS. 7C and 7D show another side view and perspective view, respectively, of supplemental filtering device 50'. However, in these views the filter element 71 is occluded and no airflow (AF1) through the passage can be established through the filter element 71. Instead, airflow AF2 opens valve 76 and airflow can occur through passageway 75. The airflow AF2 is due to the inspiration of the equine animal 10 creating a negative pressure on an inner surface of the filter element 71 relative to the outer surface of the filter element 71. Valve 76 thus serves as a safety device ensuring that the equine animal can continue to breath in air even if the filter element 71 becomes occluded. It is noted that in embodiments comprising two supplemental filtering devices, one for each nostril, one or both of the filtering devices may comprise a safety valve.

Figure 4:
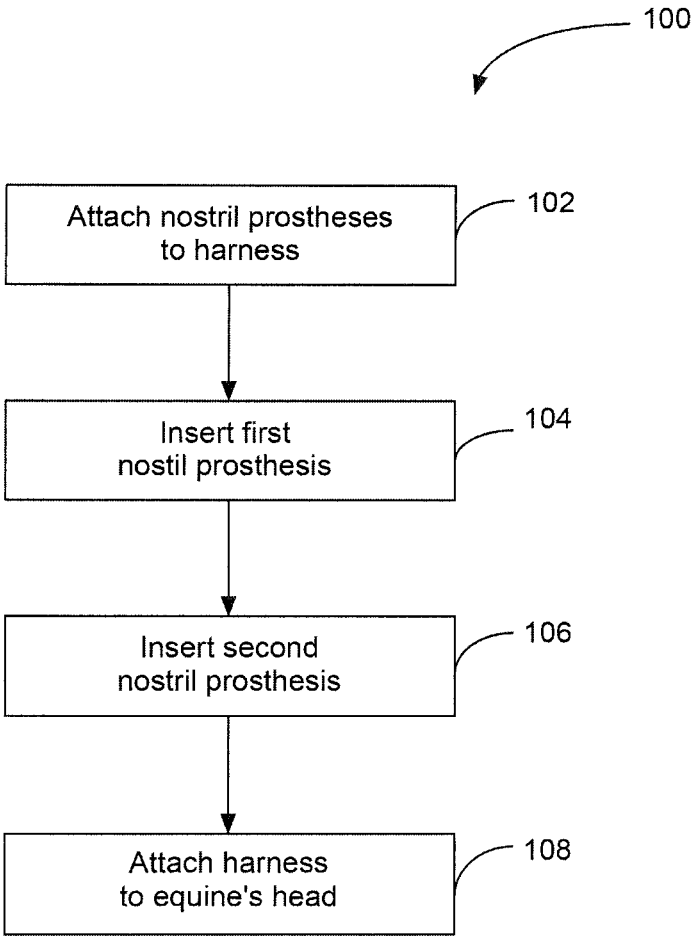
FIG. 4 is a flowchart showing an example embodiment of a method for mounting the respiratory prosthetic device of FIGS. 1B-1C to the head of an equine in accordance with the teachings herein.

Referring now to FIG. 4, shown therein is a flowchart showing an example embodiment of a method 100 for mounting one of the respiratory prosthetic devices described herein, with or without a supplemental device, to the head of an equine in accordance to the teachings herein. The method 100 refers to the device of FIGS. 1B-1C for ease of illustration. At act 102 of the method 100, the nostril prostheses 22*a* and 22*b* are attached to the harness arrangement 24. In some embodiments, the filtering devices 29*a* and 29*b* are attached to the corresponding filter housings and the filter housings are attached to the nostril prosthesis 22*a* and 22*b*, respectively, before attaching the nostril prostheses 22*a* and 22*b* to the harness arrangement 24. In other embodiments, the filter housings can be attached to the corresponding nostril prostheses 22*a* and 22*b* after the nostril prostheses 22*a* and 22*b* are attached to the harness arrangement 24 and after the harness is attached to the equine's head. At act 104 of the method 100, the first nostril prosthesis 22*a* is inserted into the corresponding nostril of the equine 10. At act 106 of the method 100, the second nostril prosthesis 22*b* is inserted into the corresponding nostril of the equine 10. At act 108 of the method 100, the harness arrangement 24 is mounted to the head of the equine 10. In an alternative embodiment, the harness arrangement 24 can first be mounted to the head of the equine 10 and the first and second nostril prosthesis 22*a* and 22*b* can then be successively moved into position in the nostrils 12 of the equine 10.

In at least one embodiment, the present disclosure further provides a use of an equine respiratory prosthetic device to prevent entry of airborne agents into the respiratory system of an equine comprising, the nostril prosthetic device comprising:

- a pair of interlinked nostril prostheses each nostril prosthesis comprising:
  - a prosthesis body being sized and shaped to fit the contours of a nostril of the equine, the prosthesis body having a first passageway therethrough and a coupling portion allowing for coupling of a supplemental filtering device to the prosthesis body;
  - a protruding portion adjacent to the prosthesis body for insertion into a nostril cavity and being sized and shaped to extend into a false nostril of the equine to thereby secure the nostril prosthesis to the nostril;
  - linking portions to allow the nostril prosthesis to be held in place;
- a supplemental filtering device coupled to the prosthesis body via the coupling portion; and
- a harness arrangement for interlinking the nostril prostheses to each other and for securing the nostril prosthesis to the head of the equine.

In at least one embodiment, the present disclosure further provides a use of an equine respiratory prosthetic device to assess respiratory performance of an equine, the respiratory prosthetic device comprising:

- a pair of interlinked nostril prostheses each nostril prosthesis comprising:
  - a prosthesis body being sized and shaped to fit the contours of a nostril of the equine, the prosthesis body having a first passageway therethrough and a coupling portion allowing for coupling of a supplemental respiratory performance device to the prosthesis body;
  - a protruding portion adjacent to the prosthesis body for insertion into a nostril cavity and being sized and shaped to extend into a false nostril of the equine to thereby secure the nostril prosthesis to the nostril; and
  - linking portions to allow the nostril prosthesis to be held in place;
- a supplemental respiratory performance device coupled to the prosthesis body via the coupling portion; and
- a harness arrangement for interlinking the nostril prostheses to each other and for securing the nostril prosthesis to the head of the equine.

In at least one embodiment, the present disclosure further provides, a use of an equine respiratory prosthetic device for the delivery of a chemical agent to the respiratory system of an equine, the respiratory prosthetic device comprising:

- a pair of interlinked nostril prostheses each nostril prosthesis comprising:
  - a prosthesis body being sized and shaped to fit the contours of a nostril of the equine, the prosthesis body having a first passageway therethrough and having a coupling portion allowing for coupling of a supplemental respiratory delivery device to the prosthesis body;
  - a protruding portion adjacent to the prosthesis body for insertion into a nostril cavity of the equine and being sized and shaped to extend into a false nostril of the equine to thereby secure the nostril prosthesis to the nostril; and
  - linking portions to allow the nostril prosthesis to be held in place;
- a supplemental device for the delivery of a chemical agent coupled to the prosthesis body via the coupling portion; and
- a harness arrangement for interlinking the nostril prostheses to each other and for securing the nostril prosthesis to the head of the equine.

In at least one embodiment, the present disclosure further provides a use of a respiratory prosthetic device to increase the airflow through the nostrils of an equine by opening the nostrils of the equine, the respiratory prosthetic device comprising:

- a pair of interlinked nostril prostheses each nostril prosthesis comprising:

a prosthesis body being sized and shaped to fit the contours of the nostril of the equine, the prosthesis body having a passageway therethrough; and a protruding portion adjacent to the prosthesis body for insertion into a nostril cavity and being sized and shaped to extend into a false nostril of the equine to thereby secure the nostril prosthesis to the nostril; and linking portions to allow the nostril prosthesis to be held in place; and a harness arrangement for interlinking the nostril prosthesis to each other and for securing the nostril prosthesis to the head of the equine.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. An equine respiratory prosthetic device comprising a nostril prosthesis comprising:

a prosthesis body being sized and shaped to fit the contours of the nostril of an equine, the prosthesis body having a first passageway therethrough; and a protruding portion adjacent to the prosthesis body for insertion into the nostril cavity and being sized and shaped to extend into a false nostril of the equine to thereby secure the nostril prosthesis to the nostril of the equine.

2. The equine respiratory prosthetic device according to claim 1 wherein the prosthesis body has a coupling portion allowing coupling of a supplemental respiratory device to the prosthesis body.

3. The equine respiratory prosthetic device according to claim 1 wherein the prosthesis body has linkage portions to receive a harness arrangement to allow the nostril prosthesis to be held in place on the head of the equine.

4. The equine respiratory prosthetic device according to claim 1 wherein the prosthesis comprises a second passageway therethrough linked to a valve, the valve allowing for airflow through the second passageway when the airflow through the first passageway is diminished below a threshold flow rate level.

5. An equine respiratory prosthetic device comprising:

a pair of interlinked nostril prostheses each nostril prosthesis comprising:

a prosthesis body being sized and shaped to fit the contours of a nostril of an equine, the prosthesis body having a first passageway therethrough and having a coupling portion allowing for coupling of a supplemental respiratory device to the prosthesis body;

a protruding portion adjacent to the prosthesis body for insertion into a nostril cavity of the equine and being sized and shaped to extend into a false nostril of the equine to thereby secure the nostril prosthesis to the nostril; and linking portions to allow the nostril prosthesis to be held in place; and a harness arrangement for interlinking the nostril prostheses to each other and for securing the nostril prosthesis to the head of the equine.

6. The equine respiratory prosthetic device according to claim 5 wherein the prosthesis body has an approximate frusto-conical shape.

7. The equine respiratory prosthetic device according to claim 5 wherein the prosthesis body and the protruding portion are integrally formed.

8. The equine respiratory prosthetic device according to claim 5 wherein the equine respiratory prosthetic device comprises a supplemental respiratory device.

9. The equine respiratory prosthetic device according to claim 8 wherein the supplemental respiratory device is removably attachable to the prosthesis body via the coupling portion.

10. The equine respiratory prosthetic device according to claim 8 wherein the supplemental respiratory device comprises a filtering device that is in gaseous communication with the prosthesis body, the filtering device being coupled to the prosthesis body via the coupling portion, and the filtering device being capable of preventing airborne agents from entering the respiratory system of the equine during use.

11. The equine respiratory prosthetic device according to claim 8 wherein the filtering device is removably attachable to the prosthesis body via the coupling portion, and the filtering device comprises a filter and a filter housing and a securing attachment disposed on an exterior surface of the filter housing, and the coupling portion of the prosthesis body comprises a corresponding securing attachment on an interior surface thereof allowing the filtering device to be attached and removed from the nostril prosthesis.

12. The equine respiratory prosthetic device according to claim 11 wherein the securing attachment disposed at the filter housing comprises threads or a clip.

13. The equine respiratory prosthetic device according to claim 8 wherein the supplemental respiratory device comprises a flow meter device capable of assessing the respiratory performance of the equine, a device for the delivery of a chemical agent to the respiratory system of the equine, a nebulizer, or a cough monitoring device.

14. The equine respiratory device according to claim 13 wherein the flow meter comprises a rotatable element disposed within the first passageway and responsive to airflow therethrough, and connected via a sensor to a monitoring device.

15. The equine respiratory device according to claim 8 wherein the prosthesis comprises at least two supplemental respiratory devices selected from a filtering device, a device capable of measuring at least one of airflow and oxygen, a device for the delivery of a chemical agent to the respiratory system of the equine, and a cough monitoring device.

16. The equine respiratory prosthetic device according to claim 5 wherein the prosthesis comprises a second passageway therethrough linked to a valve, the valve allowing for airflow through the second passageway when the airflow in the first passageway is diminished below a threshold airflow rate level.

17. The equine respiratory prosthetic device according to claim 16 wherein the supplementary device comprises a filter having a filtering element with one or more moveable flaps and the valve is formed by the one or more moveable flaps of the filtering element.

18. The equine respiratory prosthetic device according to claim 5 wherein the linking portions comprise loops to receive a first portion of the harness arrangement that is capable of securing the harness arrangement to a portion of the equine's head and to receive a second portion of the harness arrangement for coupling with the other nostril prosthesis.

19. The equine respiratory prosthetic device according to claim 5 wherein the harness arrangement comprises a face cover fabricated of a stretchable material capable of securing the harness arrangement to a portion of the equine's head, and the face cover having the nostril prostheses embedded therein.

20. A method of mounting the respiratory prosthetic device according to an equine's head, the respiratory prosthetic device being defined according to claim 5, the method comprising:

attaching the nostril prostheses to a harness including interlinking the nostril prostheses to one another;

inserting the first nostril prosthesis into a first nostril of an equine animal;

inserting the second nostril prosthesis into a second nostril of an equine animal; and attaching the harness to the head of the equine animal.

* * * * *